US010535949B2

(12) United States Patent
Lin et al.

(10) Patent No.: US 10,535,949 B2
(45) Date of Patent: Jan. 14, 2020

(54) ELECTRICAL CONNECTOR HAVING COMPLEMENTARY CONFIGURATIONS OF OPPOSITE CONTACTS

(71) Applicant: FOXCONN INTERCONNECT TECHNOLOGY LIMITED, Grand Cayman (KY)

(72) Inventors: Jun Lin, Kunshan (CN); Yue-Chao Zhao, Kunshan (CN); Kuo-Chun Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/192,758

(22) Filed: Nov. 15, 2018

(65) Prior Publication Data

US 2019/0148872 A1 May 16, 2019

(30) Foreign Application Priority Data

Nov. 15, 2017 (CN) ..... 2017 1 1125743

(51) Int. Cl.
*H01R 13/516* (2006.01)
*H01R 13/08* (2006.01)
(Continued)

(52) U.S. Cl.
CPC ..... *H01R 13/516* (2013.01); *H01R 13/08* (2013.01); *H01R 13/113* (2013.01); *H01R 13/187* (2013.01); *H01R 12/7088* (2013.01); *H01R 13/2492* (2013.01); *H01R 13/6594* (2013.01); *H01R 2103/00* (2013.01)

(58) Field of Classification Search
CPC .... H01R 13/08; H01R 13/113; H01R 13/187; H01R 13/516; H01R 13/2492; H01R 13/6594; H01R 12/7088; H01R 2103/00
See application file for complete search history.

(56) References Cited

U.S. PATENT DOCUMENTS 5,431,576 A * 7/1995 Matthews ..... H01R 13/113 439/247
6,120,328 A * 9/2000 Bricaud ..... G06K 7/0021 439/630

(Continued)

FOREIGN PATENT DOCUMENTS

CN 107492727 A 12/2017

*Primary Examiner* — Oscar C Jimenez
(74) *Attorney, Agent, or Firm* — Wei Te Chung; Ming Chieh Chang

(57) ABSTRACT

An electrical receptacle connector includes an insulative housing forming a pair of receiving slots, two pairs of contacts are retained in the housing and located by two sides of the corresponding receiving slots, respectively. Each contact has a frame having four sides with a pair of first spring arms extending from two opposite sides toward each other and extending into the receiving slot with the corresponding contact points at different levels. A second spring arm extends from another side into the receiving slot. A deflection direction of the first spring arms is perpendicular to that of the second spring arm, and the first spring arms contact one side of the blade type contact of the plug connector and the second spring arm contacts another side of the blade type contact of the plug connector.

16 Claims, 16 Drawing Sheets

(51) Int. Cl.

| | |
|---|---|
| ***H01R 13/187*** | (2006.01) |
| ***H01R 13/11*** | (2006.01) |
| ***H01R 103/00*** | (2006.01) |
| ***H01R 13/24*** | (2006.01) |
| *H01R 12/70* | (2011.01) |
| *H01R 13/6594* | (2011.01) |

(56) References Cited

U.S. PATENT DOCUMENTS

| | | | | |
|---|---|---|---|---|
| 6,299,492 | B1 * | 10/2001 | Pierini | H01R 13/26 439/884 |
| 8,821,170 | B1 * | 9/2014 | Thein | H01R 4/4881 439/121 |
| 2005/0277336 | A1 * | 12/2005 | Yang | H01R 13/187 439/636 |
| 2008/0038957 | A1 * | 2/2008 | Hsu | H01R 13/245 439/492 |
| 2014/0127954 | A1 * | 5/2014 | Ando | H01R 13/113 439/884 |
| 2017/0062966 | A1 * | 3/2017 | Stange | H01R 13/113 |
| 2017/0358879 | A1 * | 12/2017 | Li | H01R 13/514 |
| 2017/0373419 | A1 * | 12/2017 | Lee | H01R 13/4226 |
| 2018/0115099 | A1 * | 4/2018 | Endo | H01R 12/778 |

* cited by examiner

ELECTRICAL CONNECTOR HAVING COMPLEMENTARY CONFIGURATIONS OF OPPOSITE CONTACTS

BACKGROUND OF THE DISCLOSURE

1. Field of the Disclosure

The present disclosure relates to an electrical connector assembly, and more particularly to an electrical receptacle connector forming a pair of receiving slots each equipped with a pair of opposite contacts by two sides to sandwich the blade contact of a mating plug connector wherein each contact has a pair of spring beams spaced from each other with corresponding contacting points at different levels.

2. Description of Related Arts

U.S. Pat. No. 10,135,163 having the same applicant with the instant invention, discloses a receptacle connector including an insulative housing forming a plurality of receiving slots therein. A pair of opposite contacts are respectively disposed by two sides of each receiving slot. Each contact includes a planar frame body with a pair of spring beams extending toward each other in an offset manner having two corresponding contacting points at different levels. Therefore, the blade type contact of the mating plug connector received within the receiving slot is sandwiched between the pair of contacts with total four contacting points thereof in an offset and asymmetrical manner. Even though the multiple contact points benefit the retentional mating force between the mated plug connector and receptacle connector, the more stationary coupling between the pair of receptacle contacts and the blade type plug contact is preferred.

An improved electrical receptacle connector having paired receptacle contacts for sandwiching the corresponding blade type contact of the complementary plug connector is desired.

SUMMARY OF THE DISCLOSURE

An object of the invention is to provide a receptacle connector which can be mated with the plug connector in a more stable manner.

To achieve the above object, an electrical receptacle connector includes an insulative housing forming a pair of receiving slots, two pairs of contacts are retained in the housing and located by two sides of the corresponding receiving slots, respectively. Each contact has a frame having four sides with a pair of first spring arms extending from two opposite sides toward each other and extending into the receiving slot with the corresponding contact points at different levels. A second spring arm extends from another side into the receiving slot. A deflection direction of the first spring arms is perpendicular to that of the second spring arm, and the first spring arms contact one side of the blade type contact of the plug connector and the second spring arm contacts another side of the blade type contact of the plug connector. Both the first spring arms and the second spring arm are of a cantilevered type. The second spring arm may enhance the retention force between the receptacle contact and the plug contact. Alternately, the pair of first spring arms may be of a fixed beam rather than a cantilevered beam to significantly increase the formal force thereof during deflection. Under such situation, the second spring arm may be omitted optionally Other objects, advantages and novel features of the disclosure will become more apparent from the following detailed description when taken in conjunction with the accompanying drawings.

DETAILED DESCRIPTION OF THE PREFERRED EMBODIMENT

Figure 1:
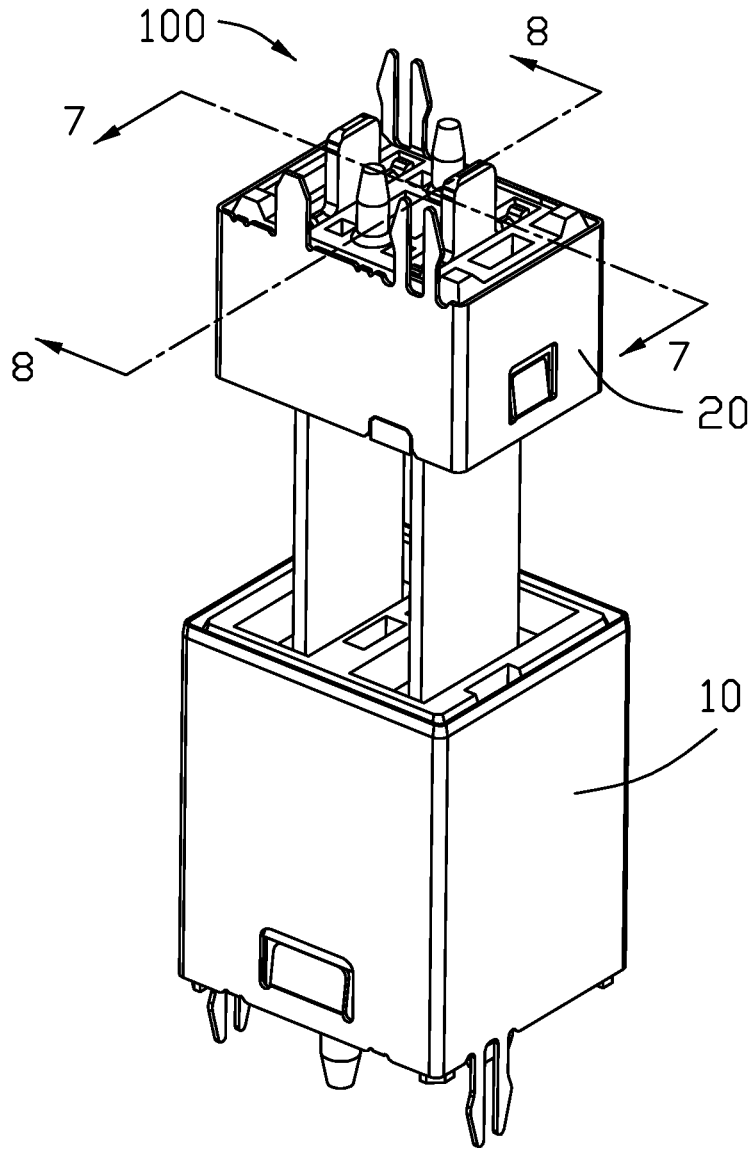
FIG. 1 is a perspective view of an electrical connector assembly of a first embodiment of the invention according to the first embodiment.
Figure 2:
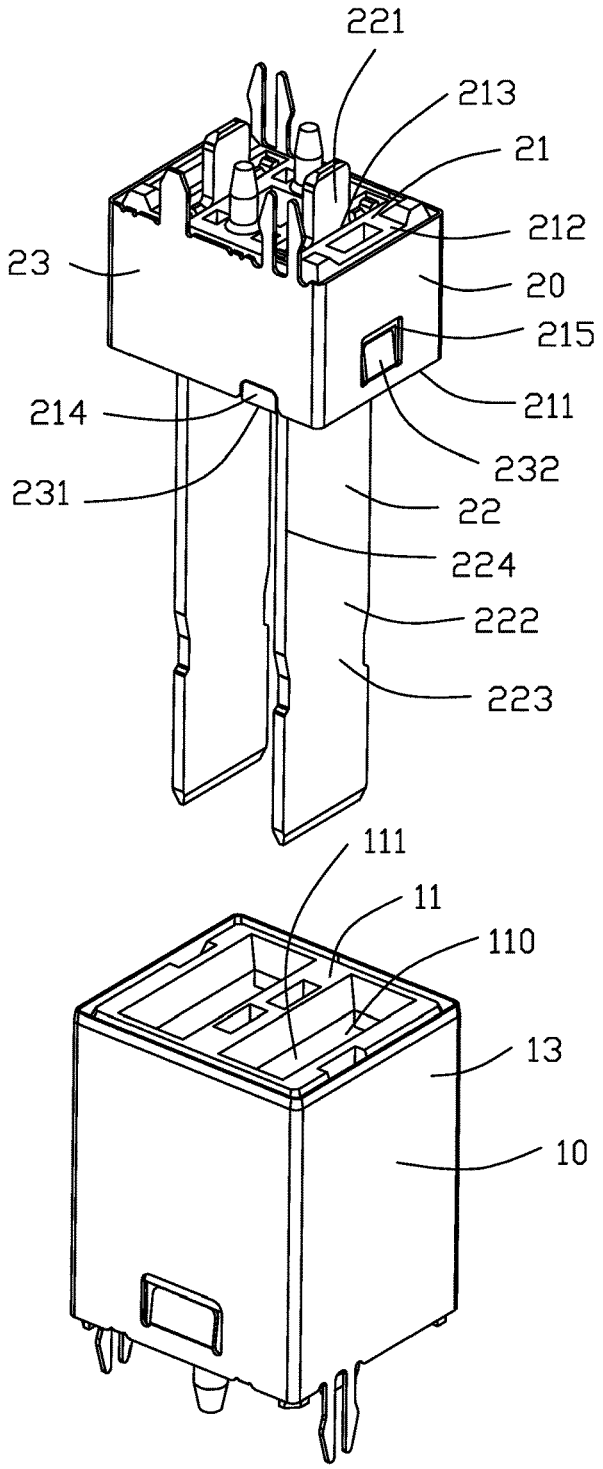
FIG. 2 is a perspective view of the separate receptacle connector and plug connector of the electrical connector assembly of FIG. 1.
Figure 3:
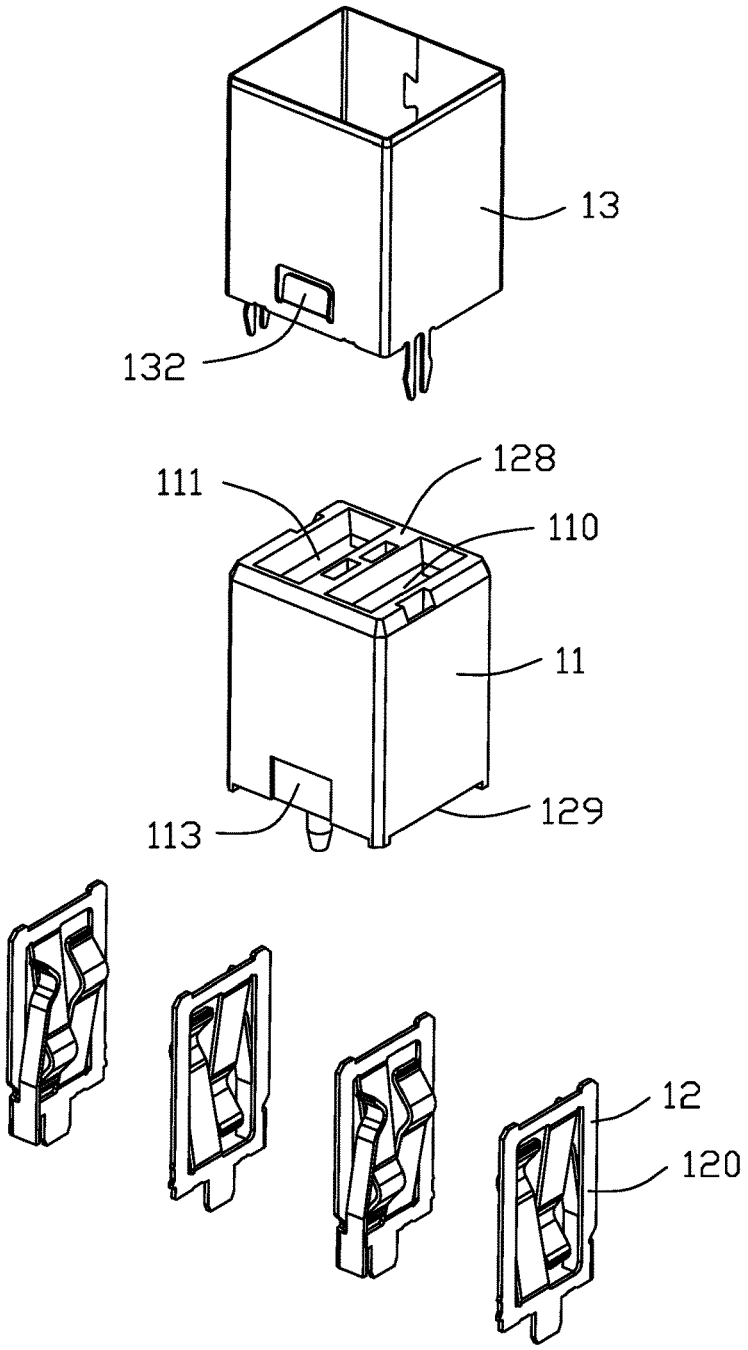
FIG. 3 is an exploded perspective view of the receptacle connector of FIG. 2.
Figure 4:
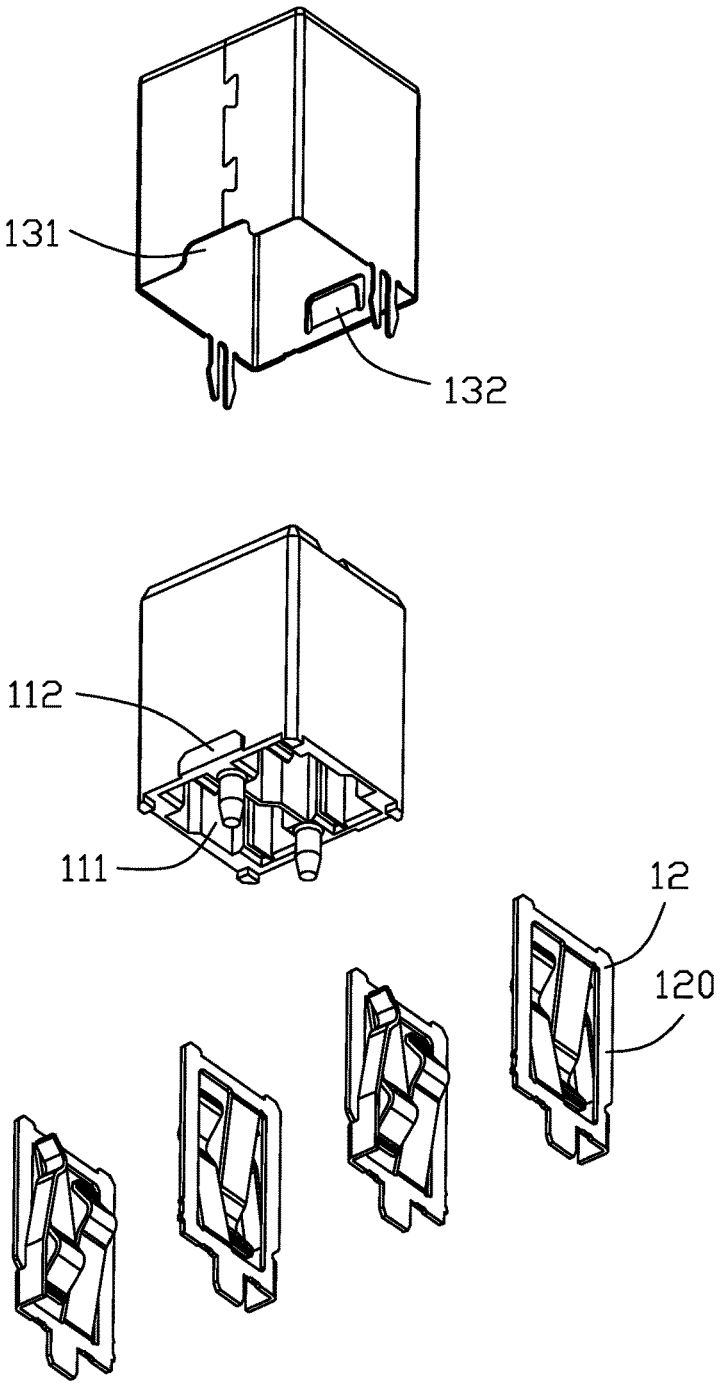
FIG. 4 is another exploded perspective view of the receptacle connector of FIG. 2.
Figure 5:
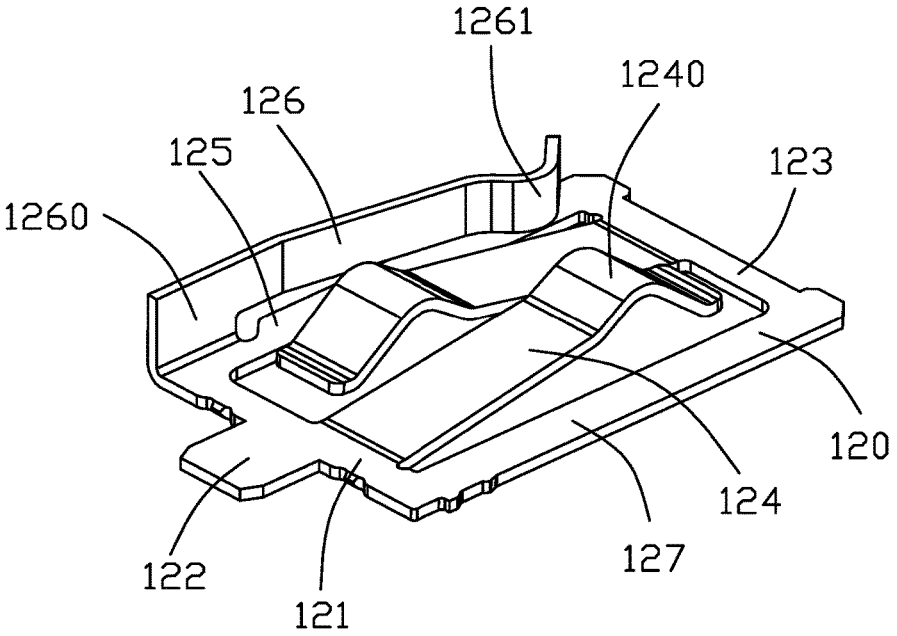
FIG. 5 is a perspective view of the receptacle contact of the receptacle connector of FIG. 4.
Figure 6:
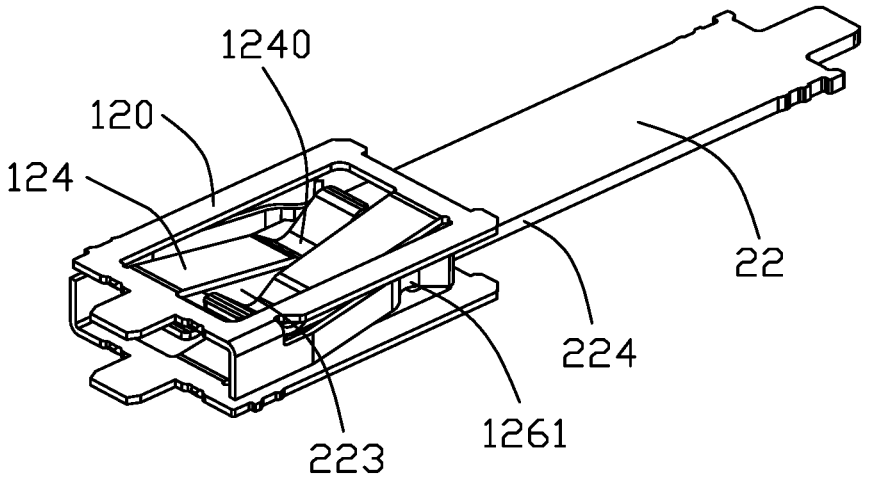
FIG. 6 is a perspective view to show the mated plug contact and receptacle contacts.

Reference will now be made in detail to the embodiments of the present disclosure. The reference numerals are referred to the different embodiments, respectively.

Referring to FIGS. 1-8, an electrical connector assembly 100 includes the receptacle connector 10 and the plug connector 20 mated with each other. The receptacle connector 10 includes an insulative (receptacle) housing 11, two pair of conductive receptacle contacts 12 and a metallic (receptacle) shell 13 enclosing the housing 11. The plug connector 20 includes an insulative (plug) housing 21, a pair of conductive plug contacts 22 and a metallic (plug) shell 23 enclosing the housing 21.

The housing 11 includes a first mating face 128 and a first mounting face 129 opposite to the first mating face 128. A pair of receiving slots 110 extend through both the first mating face 128 and the first mounting face 129 in a vertical direction. Each receiving slot 110 is surrounded by four walls 111. Each receiving slot 110 is equipped with a pair of opposite receptacle contacts 12 by two sides of the receiving slot 110 and spaced from each other in a longitudinal direction perpendicular to the vertical direction. Each receptacle contact 12 include a frame body 120 surrounding a void. The frame body 120 is retained to the corresponding wall 111. The metallic shell 13 is downwardly assembled to the housing 11. The housing 11 includes a first block 112 received within a first notch 131 of the metallic shell 13. The metallic shell 13 forms a first spring tang 132 engaged within a first recess 113 of the housing 11. Therefore, the metallic shell 13 is secured to the insulative housing 11.

The frame body 120 includes opposite first/lower side/bar 121 and second/upper side/bar 123 spaced from each other in the vertical direction, and opposite third/lateral side/bar 125 and four/lateral side/bar 127 spaced from each other in a transverse direction perpendicular to both the vertical direction and the longitudinal direction, and connecting the first side 121 and the second side 123. A pair of barbs (not labeled) are formed on two opposite sides for retention. A pair of first spring arms 124 respectively extend from the first side 121 and the third side 123 in an offset manner along the transverse direction, and toward each other in the vertical direction with corresponding first contacting sections 1240 extending into the receiving slot 110 in an offset manner along the vertical direction. Notably, the pair of first contacting sections 1240 extend away from the frame body 120 with a same extent in the longitudinal direction and terminated at a same vertical plane. In each receiving slot 110, the pair of first spring arms 124 of one of the paired receptacle contacts 12 are complementary/coupled with another pair of first spring arms 124 of the other of the paired receptacle contacts 12 along the vertical direction in an offset manner without interference therebetween. In other words, the first contacting section 1240 of one spring arm 124 of the one of the paired receptacle contacts 12, which is located at a high position, complementarily confronts the first contacting section 1240 of the other of the paired receptacle contacts 12, which is locate at a low position, in a cross-sectional plane, and the first contacting section 1240 of the other spring arm of the one of the paired receptacle contacts 12, which is located low position, complementarily confronts the first contacting section 1240 of the other of the paired receptacle contacts 12, which is located in a high position, in another cross-sectional plane spaced from the aforementioned cross-sectional plane in the transverse direction. In brief, the first spring arms 124 of one of the paired receptacle contacts 12 are complementary/coupled with those of the other of the paired receptacle contacts 12 in both the vertical direction and the longitudinal direction.

The receptacle contact 12 further includes a second spring arm 126 extending from the third side 125 and including a base 1260 connected to the third side of the frame body 120 and closer to the first side 121 than to the second side 123, and a second contacting section 1261 extending from the base 1260 toward the second side 123 and into the receiving slot 110. Notably, the second spring arms 126 of the paired receptacle contacts 12 are respectively located upon the corresponding walls 111 opposite to each other in the transverse direction. For each receptacle contact 12, the deflection direction of the first spring arm 124 is perpendicular to that of the second spring arm 126. The receptacle contact 12 further includes a leg 122 extending downwardly from the first side 121. For each receptacle contact 12, the second spring arm 126 is closer to one first spring arm 124, which downwardly extends from the second side 123 and has the corresponding first contacting section 1240 at the lower position, than to the other first spring arm 124 which upwardly extends from the first side 121 and has the corresponding first contacting section 1240 at the upper position.

The housing 21 of the plug connector 20 has opposite second mating face 211 and second mounting face 212, and a pair of retention slots 213 extending through both the second mating face 211 and second mounting face 212. The plug contact 22 has a retention section 221 retained in the retention slot 213, and a blade type mating section 222 extending beyond the second mating face 211 and inserted into the receiving slot 110 of the receptacle connector 10 to contact with the first contacting sections 1240 and the second contacting section 1261 of the paired receptacle contacts 12.

In mating, the pair of plug contacts 22 of the plug connector 20 are inserted into the pair of receiving slots 110 of the receptacle connector 10, respectively, along the mating/vertical direction. As mentioned before, the downwardly extending first spring arms 124 of the paired receptacle contacts 12 are offset from each other in the transverse direction, and the upwardly extending first spring arms 124 of the paired receptacle contacts are as well so that in a cross-sectional view, the upwardly extending first spring arm 124 of one of the paired receptacle contacts 12 couples with the downward extending first spring arm 124 of the other of the paired receptacle contacts 12 in a complementary/coupled manner without interference. Correspondingly, the blade type mating section 222 of the plug contact 22 includes two wide/spanning faces 223 and two narrow/edge faces 224. The pair of first spring arms 124 of each of the paired receptacle contact 12 abuts against the same one wide face 223 and the second spring arm 126 abuts against one narrow face 224. Therefore, each blade type mating section 222 is stably surrounded by four sides on the pair of wide faces 223 and the pair of narrow faces 224 by the pair of receptacle contacts 12. In the plug connector 20, the insulative housing 21 includes the second block 214 and the second recess 215 for engagement with the second notch 231 and the second spring tang 232 of the plug shell 23.

Figure 7:
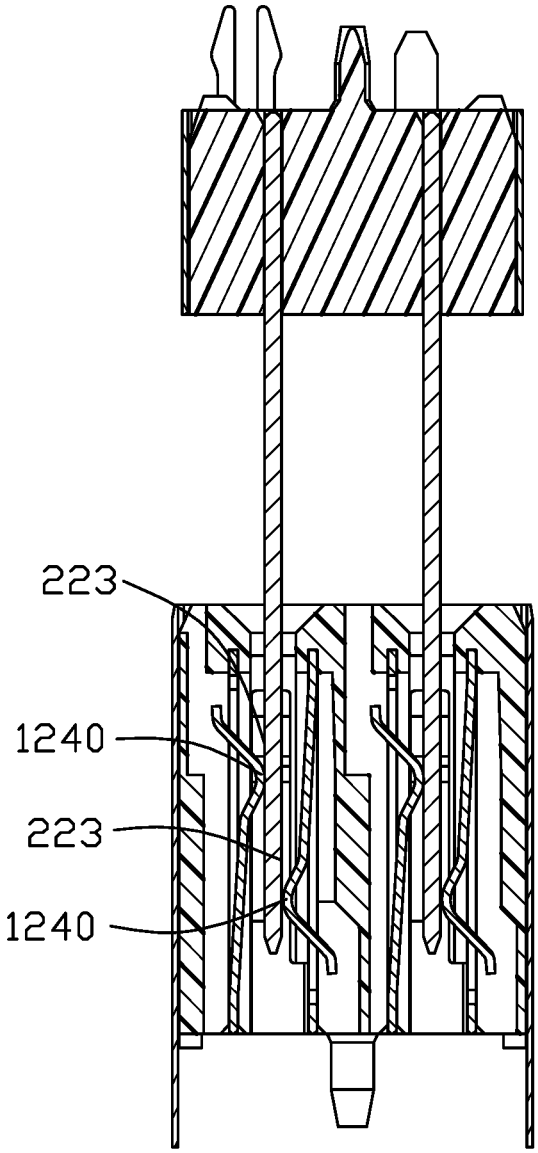
FIG. 7 is a cross-sectional view of the electrical connector assembly of FIG. 1.
Figure 7A:
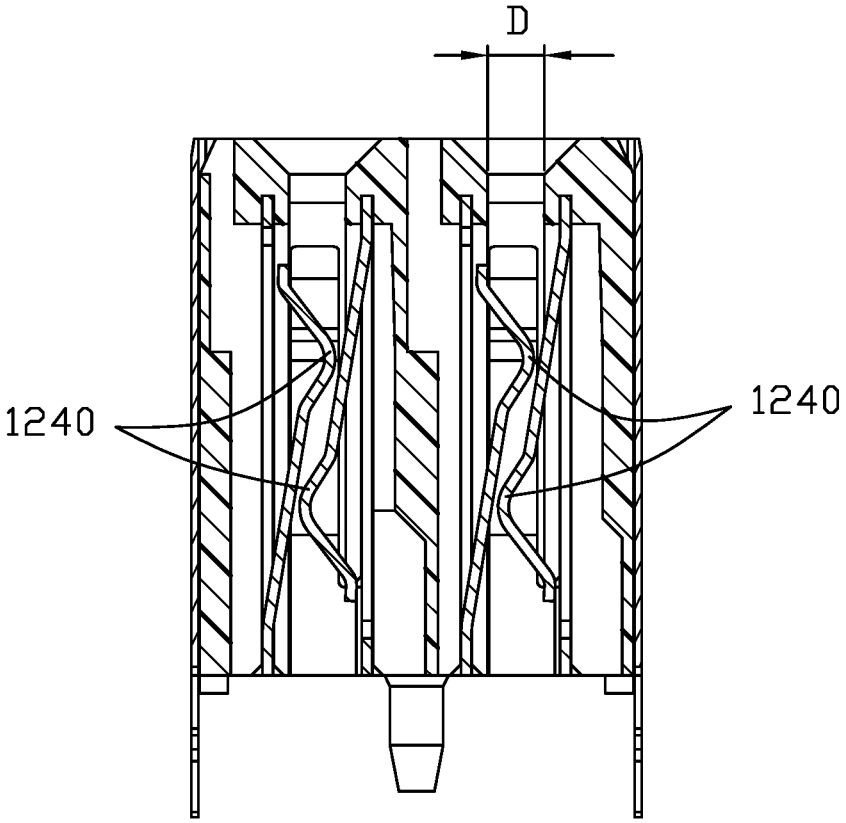
FIG. 7(A) is a cross-sectional view of the receptacle connector of FIG. 2.
Figure 8:
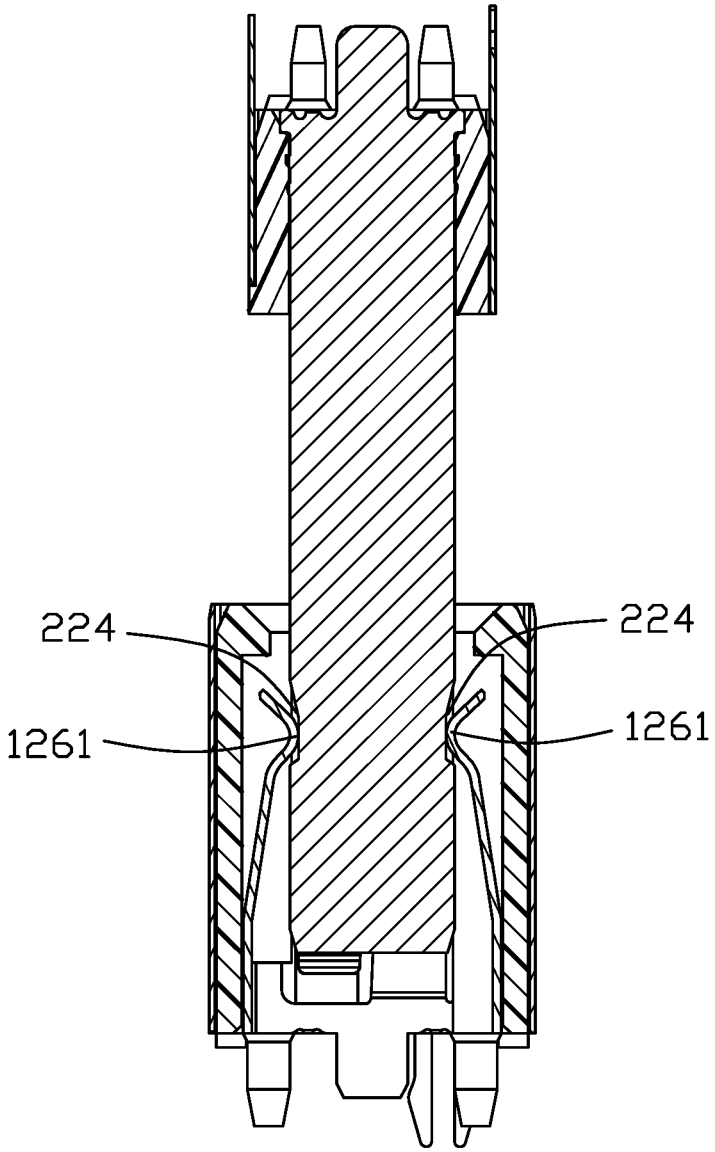
FIG. 8 is another cross-sectional view of electrical connector assembly of FIG. 1.
Figure 9:
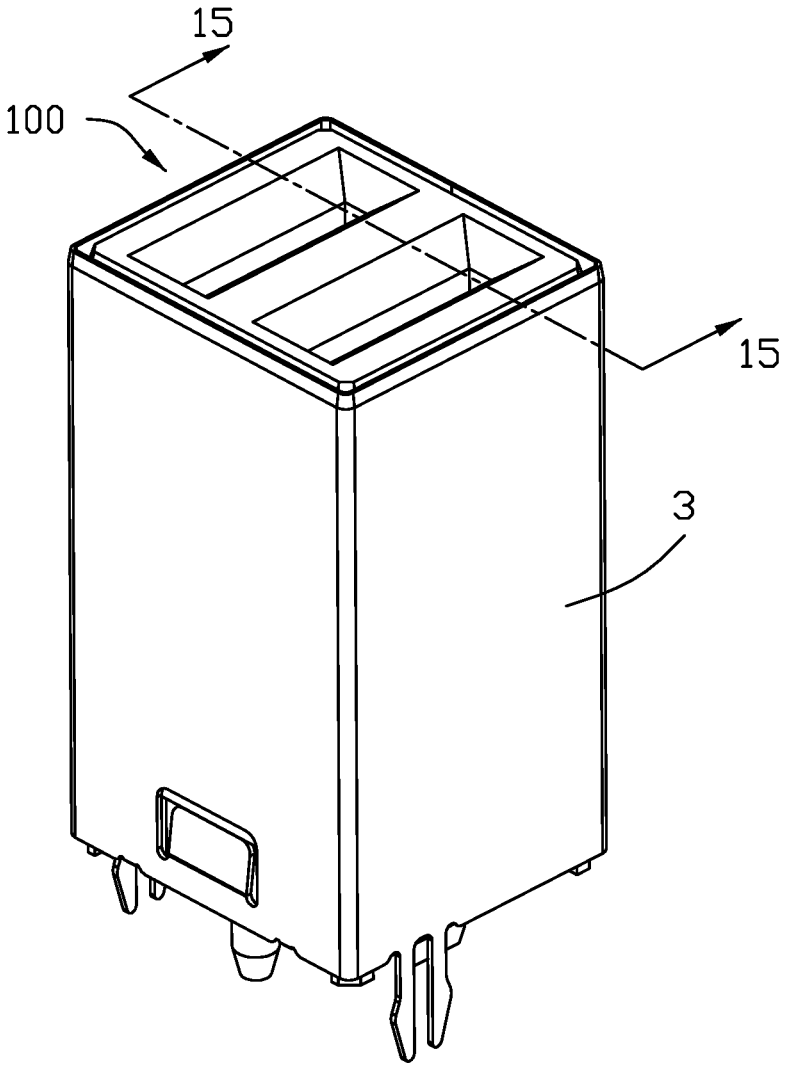
FIG. 9 is a perspective view of the receptacle connector of the invention according to a second embodiment.
Figure 10:
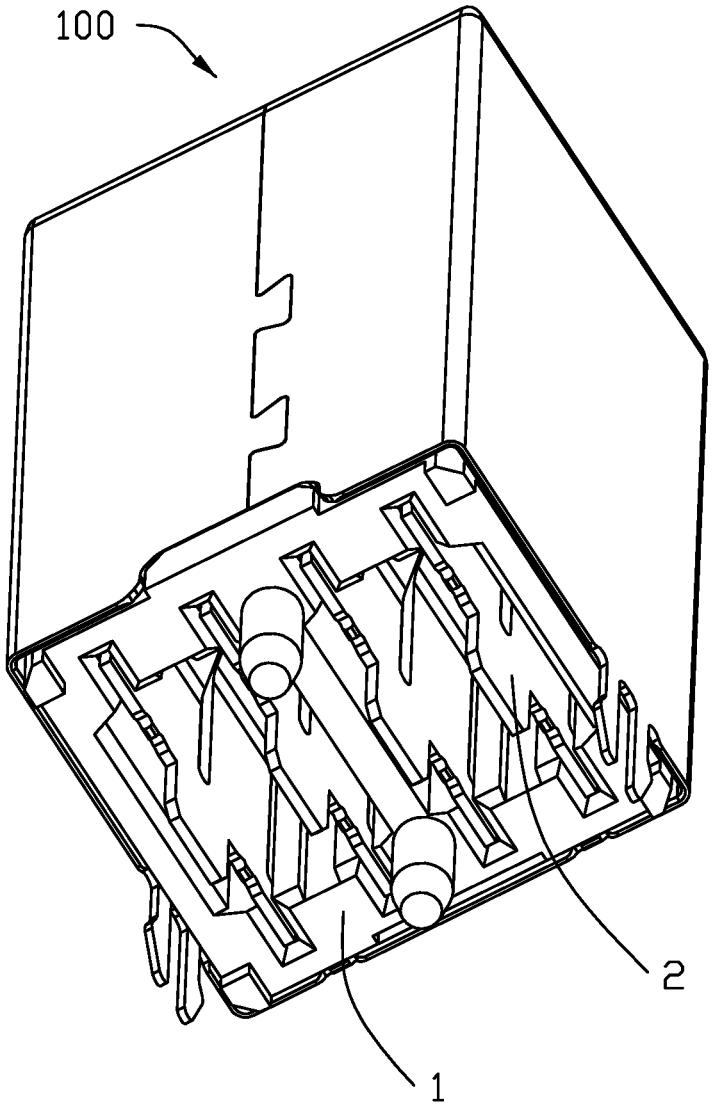
FIG. 10 is another perspective view of the receptacle connector of FIG. 9.
Figure 11:
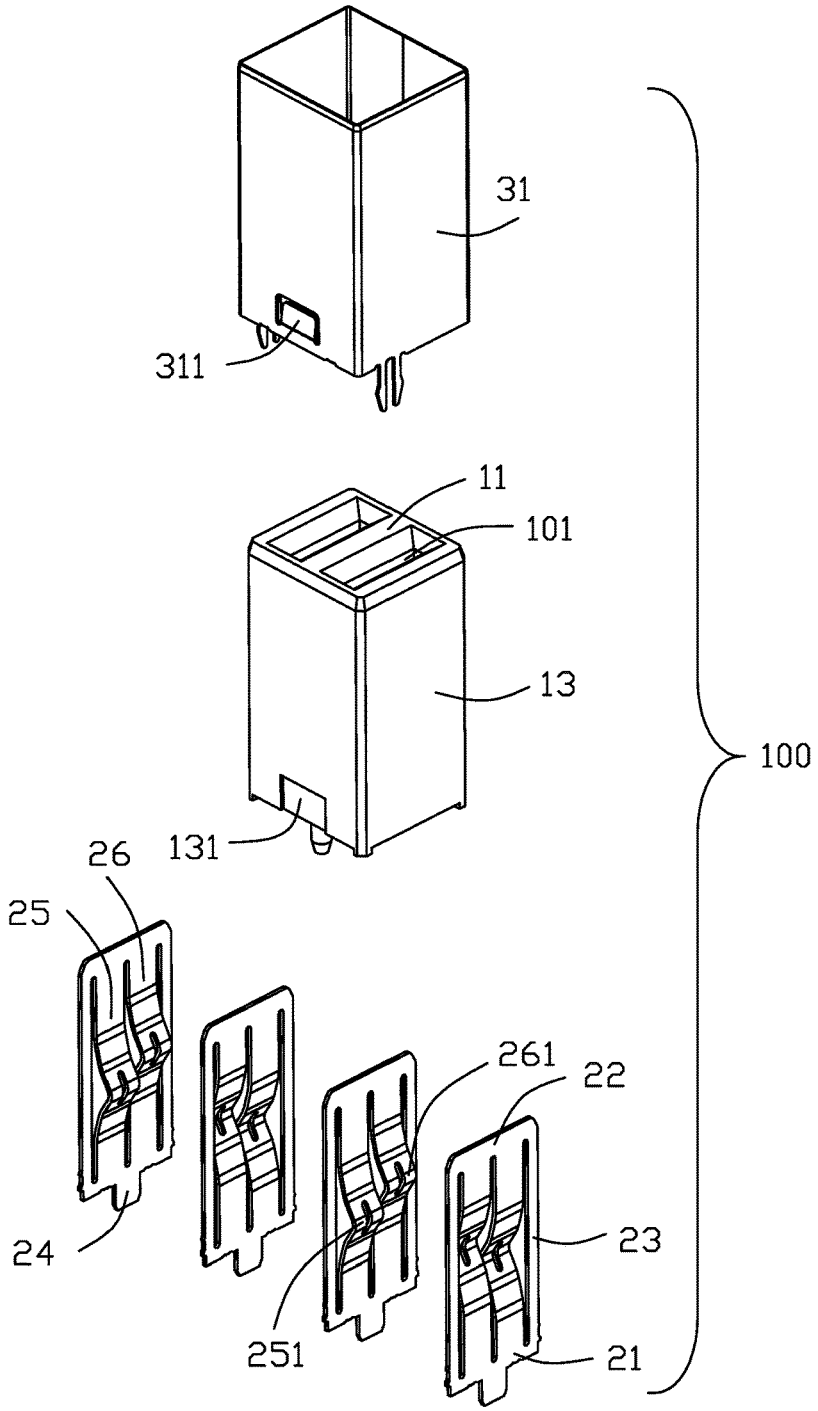
FIG. 11 is an exploded perspective view of the receptacle connector of FIG. 9.
Figure 12:
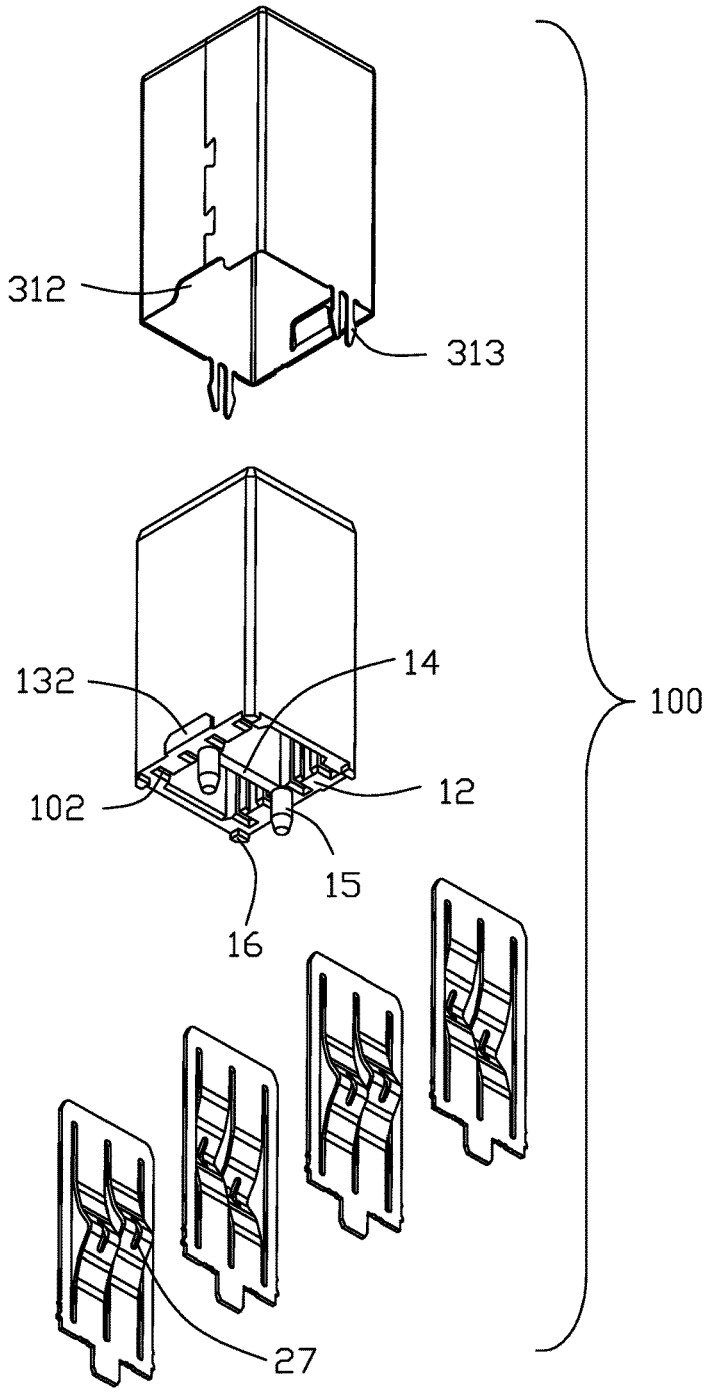
FIG. 12 is another exploded perspective view of the receptacle connector of FIG. 11.
Figure 13:
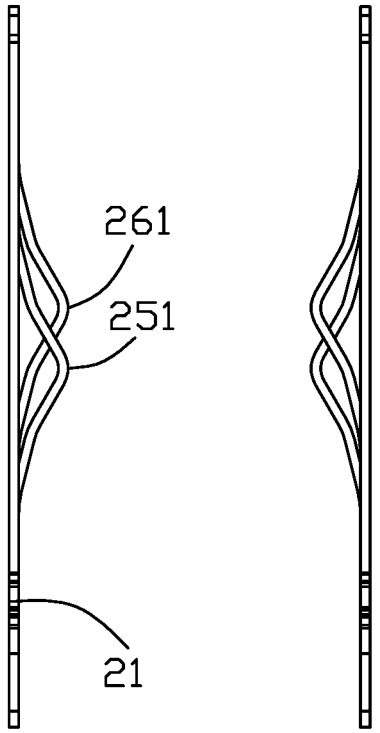
FIG. 13 is a side view of the pair of receptacle contacts of the receptacle connector of FIG. 11 in a spaced manner.
Figure 14:
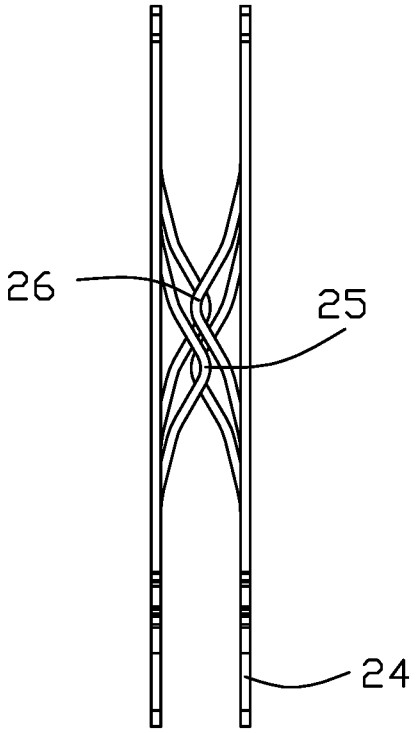
FIG. 14 is a side view of the pair of receptacle contacts of the receptacle connector of FIG. 13 in a mated manner.
Figure 15:
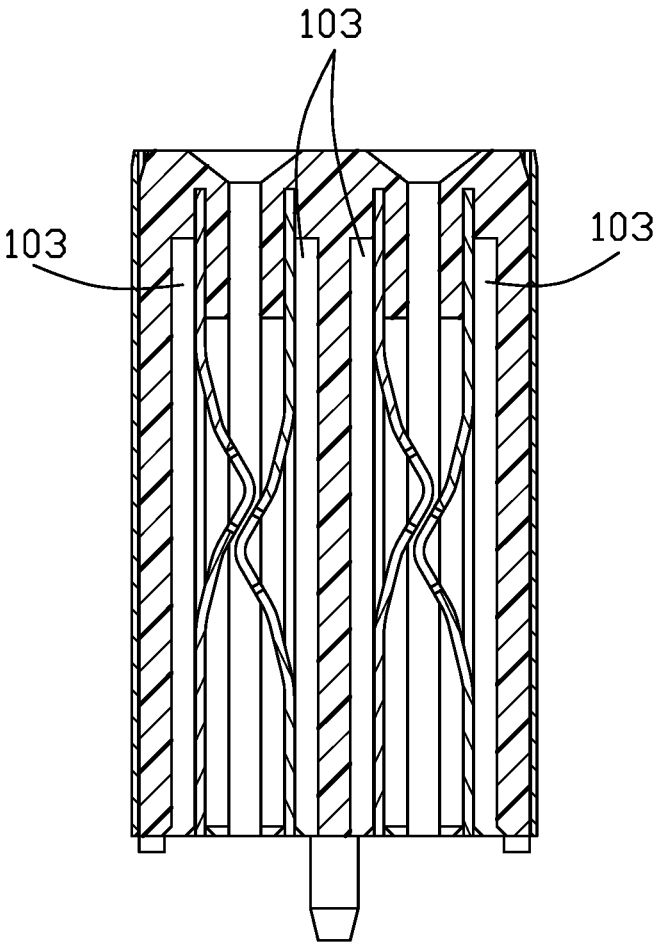
FIG. 15 is a cross-sectional view of the electrical connector of FIG. 9.

One feature of the invention is that in the cross-sectional view the complementarily coupled upwardly extending first spring arm 124 of one of the pair of receptacle contacts 12 and downwardly extending first spring arm 124 of the other of the pair of receptacle contact 12 are overlapped in the vertical direction in a maximum manner. In other words, as shown in FIG. 7(A), the apex of the first contacting section 1240 crosses almost four fifths of a width D of the receiving slot 110 in the longitudinal direction, thus significantly enhancing the retention force with regard to the inserted blade type mating section 222 of the plug connector 20. Understandably, compared with the symmetrically arranged contacting sections by two sides of the receiving slot of the paired receptacle contacts, the asymmetrically and complementarily arranged paired receptacle contacts 12 may such an enhancement benefit advantageously. Anyhow, to achieve this feature, the apex of the contacting section 1240 had better not be located at the mid-position of the receiving slot 110 in the vertical direction but either above or below the mid-position so as to result in different positions of the pair of spring arms 124 in the vertical direction. Clearly, in each receptacle contact 12 the pair of first spring arms 124 prefer to be same with each other; otherwise, no perfect complementary/coupled arrangement may be obtained for the paired receptacle contacts in the same receiving slot 110. In this embodiment, in each receptacle contact 12 the contacting section 1240 of one first spring arm 124 should be symmetrically arranged with that of the other first spring arm 124 with regard to the mid-position of the receiving slot 110 in the vertical direction. In this embodiment, the pair of first spring arms 124 share the same name; anyhow, the pair of spring arms 124 can be respectively named as the first spring arm/beam and the second spring arm/beam for easy illustration. Thus, the original second spring arm 126 can be rename as the third spring arm/beam alternately. In another embodiment, the pair of first spring arms maybe extend from the same lower bar or upper bar as long as the contacting sections of the pair of spring arms are located at different positions in the vertical direction. In this embodiment, in a side view the contacting sections of the pair of spring arms extend beyond the mid-level between the upper and lower sides and further pass each other in the vertical direction; alternately, in another embodiment, in a side view the contacting sections of the pair of first spring arms may be stopped before reaching each other in the vertical direction.

Referring to FIGS. 9-15, a connector 100 includes an insulative housing 1, two pairs of contacts 2 retained in the housing, and a metallic shell 3 enclosing the housing 1. The housing 1 includes a mating face 11 and a mounting face 12 opposite to the mating face 11, and four side faces 13. A pair of receiving slots 101 extend through both the mating face 11 and the mounting face 12. A divider 14 is formed between the pair of receiving slots 101. A pair of retention slots 102 are formed in the housing 1 beside each receiving slot 101. Each contact 2 is received within the retention slot 101. Notably, the retention slot 102 extends through the mounting face 12 to allow the contact 2 to be assembled upwardly thereinto. Similar to the first embodiment, the face 13 forms a recess 131 to receive a spring tang 311 of the shell 3 therein, and another face 13 forms a block 132 to be received within a notch 312 of the shell 3, thus assuring securement between the housing 1 and the shell 3. The housing 1 further includes a pair of positioning posts 15 and four standoffs 16 at four corners. The shell forms a shielding portion 31 covering four faces 13 of the housing. A pair of securing legs 313 extend downwardly from the bottom edge of the shielding portion 31.

Each contact 2 is of a plate structure includes a first/lower side/bar 21, a second/upper side/bar 22 opposite to each other in the vertical direction, and a pair of lateral sides/bars 23 connected therebetween so as to form a frame body. A leg 24 extends downward from the first side 21. A first spring arm 25 and a second spring arm 26 commonly unitarily extend between the first side 21 and the seconds side 26 in a fixed beam type. The first spring arm 25 forms a first spring section 251 extending into the receiving slot 101 in the longitudinal direction, and the second spring arm 26 forms a second contacting section 261 extending into the receiving slot 101 as well. The first contacting section 251 is lower than the second contacting section in the vertical direction and closer to the first side 21 than to the second side 22. Analogous to the first embodiment, the distance between the first contacting section 251 and the first side 21 is equal to that between the second contacting section 261.

Notably, each receiving slot 101 is equipped with a pair of contacts 2 by two sides spaced with each other in the longitudinal direction. Therefore, the first spring arm 25 of one of the pair of contacts 2 is aligned with the second spring arm 26 of the other of the pair of contacts 2 in the longitudinal direction, and vice versa. Similar to those in the first embodiment, in a cross-sectional view the coupled first spring arm 25 and second spring arm 26 are overlapped in the vertical direction in a complementary/coupled manner. Each first spring arm 25 and each second spring arm 26 forms a slit 27 for stress relief consideration during mating. Understandably, in this embodiment, the third sides 23 may be omitted because both the first spring arm 25 and the second spring arm 26 inherently link the first side 21 and the second side 22 together due to characters of the fixed beam structure thereof. Similar to the first embodiment, the housing 1 further includes a recess 103 behind the retention slot 102 to allow deflection of the first/second spring arm 25/26. In brief, the apex of the first contacting section 251 and that of the second contacting section 261 had better be symmetrically arranged with each other with regard to the mid-level/position of the receiving slot 101 in the vertical direction so as to achieve the complementary/coupled arrangement between the coupled first spring arm 251 of one of the pair of contacts 2 and second spring arm 261 of the other of the pair of contacts 2 in a cross-sectional view.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical receptacle connector comprising:

an insulative housing defining at least one receiving slot communicating with an exterior in a vertical direction;

a pair of contacts retained in the housing and located by two sides of the receiving slot and spaced from each other in a longitudinal direction perpendicular to the vertical direction;

each of said contacts includes a lower bar and an upper bar spaced from each other in the vertical direction, a first spring arm unitarily extending upwardly from the lower bar and a second spring arm unitarily extending downwardly from the upper bar, the first spring arm being spaced from the second spring arm in a transverse direction perpendicular to both the vertical direction and the longitudinal direction, each of the first spring arm and the second spring arm having a contacting section protruding into the receiving slot in the longitudinal direction, the contacting section of the first spring arm and that of the second spring arm being located at different positions in the vertical direction; wherein the first spring arm of one of the pair of contacts is aligned with the second spring arm of the other of the pair of contact in the longitudinal direction in a complementary/coupled manner, and vice versa, so as to have the contacting section of the first spring arm of said one of the pair of contacts is overlapped with that of the second spring arm of said other of the pair of contacts in the vertical direction, and vice versa wherein each of said contacts further includes a pair of side bars linked between the upper bar and the lower bar beside the first spring arm and the second spring arm in the transverse direction, wherein in each of said contacts, one of the side bars is further equipped with a third spring arm extending in the vertical direction with a corresponding contacting section protruding into the receiving slot along the transverse direction.

2. The electrical receptacle connector as claimed in claim 1, wherein an overlapped area between the first spring arm and the second spring arm takes more than one half of a width of the receiving slot.

3. The electrical receptacle connector as claimed in claim 1, wherein in each coupled first spring arm and second spring arm of the pair of respective contacts, the apex of the contacting section of one of said spring arm and said second spring arm is located below a mid-position of the receiving slot while that of the other of said spring arm and said second spring arm is located above the mid-position in a symmetrical manner in said vertical direction.

4. The electrical receptacle connector as claimed in claim 1, wherein in each of said contacts, the first spring arm is further unitarily linked with the upper bar, and the second spring arm is further unitarily linked with the lower bar.

5. The electrical receptacle connector as claimed in claim 1, wherein the first spring arm and the second spring arm are same with each other in configuration and dimension.

6. The electrical receptacle connector as claimed in claim 1, wherein the contacting section of the first spring arm is higher than that of the second spring arm in the vertical direction.

7. An electrical connector assembly comprising:

a plug connector including a blade type mating contact defining a pair of wide faces and a pair of narrow faces thereon;

a receptacle connector mated with the plug connector and including:

a pair of contacts retained in a housing and located by two sides of a receiving slot and spaced from each other in a longitudinal direction perpendicular to a vertical direction;

each of said contacts includes a lower bar and an upper bar spaced from each other in the vertical direction, a first spring arm unitarily extending upwardly from the lower bar and a second spring arm unitarily extending downwardly from the upper bar, the first spring arm being spaced from the second spring arm in a transverse direction perpendicular to both the vertical direction and the longitudinal direction, the first spring arm being same with the second spring arm in configuration and dimension, each of the first spring arm and the second spring arm having a contacting section protruding into the receiving slot in the longitudinal direction, the contacting section of the first spring arm and that of the second spring arm being located at different positions in the vertical direction; wherein the first spring arm of one of the pair of contacts is aligned with the second spring arm of the other of the pair of contact in the longitudinal direction in a complementary/coupled manner, and vice versa, so as to have the contacting section of the first spring arm of said one of the pair of contacts is overlapped with that of the second spring arm of said other of the pair of contacts in the vertical direction, and vice versa; wherein during mating, the blade type mating contact is inserted into the receiving slot, and the first spring arm and the second spring arm of one of the pair of contacts abut against one of the wide faces, and those of the other of the pair of contacts abut against the other of the wide faces wherein each of said contacts further includes a pair of side bars linked between the upper bar and the lower bar beside the first spring arm and the second spring arm in the transverse direction, wherein in each of said contacts, one of the side bars is further equipped with a third spring arm extending in the vertical direction with a corresponding contacting section protruding into the receiving slot along the transverse direction.

8. The electrical connector assembly as claimed in claim 7, wherein an overlapped area between the first spring arm and the second spring arm takes more than one half of a width of the receiving slot.

9. The electrical connector assembly as claimed in claim 7, wherein in each coupled first spring arm and second spring arm of the pair of respective contacts, the apex of the contacting section of one of said spring arm and said second spring arm is located below the mid-position in the receiving slot while that of the other of said spring arm and said second spring arm is located above the mid-position in a symmetrical manner in said vertical direction.

10. The electrical connector assembly as claimed in claim 7, wherein the third spring of one of the pair of contacts abuts against one of the narrow faces, and that of the other of the pair of contacts abuts against the other of the narrow faces.

11. The electrical connector assembly as claimed in claim 7, wherein in each of said contacts, the first spring arm is further unitarily linked with the upper bar, and the second spring arm is further unitarily linked with the lower bar.

12. An electrical receptacle connector comprising:

an insulative housing defining at least one receiving slot communicating with an exterior in a vertical direction;

a pair of contacts retained in the housing and located by two sides of the receiving slot and spaced from each other in a longitudinal direction perpendicular to the vertical direction;

each of said contacts includes a body with a first spring arm and a second spring arm unitarily extending therefrom, the first spring arm being spaced from the second spring arm in a transverse direction perpendicular to both the vertical direction and the longitudinal direction, each of the first spring arm and the second spring arm having a contacting section protruding into the receiving slot in the longitudinal direction, the contacting section of the first spring arm and that of the second spring arm being located at different positions in the vertical direction; wherein the first spring arm of one of the pair of contacts is aligned with the second spring arm of the other of the pair of contact in the longitudinal direction in a complementary/coupled manner, and vice versa, so as to have the contacting section of the first spring arm of said one of the pair of contacts is overlapped with that of the second spring arm of said other of the pair of contacts in the vertical direction, and vice versa wherein each of said contacts further includes a pair of side bars linked between the upper bar and the lower bar beside the first spring arm and the second spring arm in the transverse direction, wherein in each of said contacts, one of the side bars is further equipped with a third spring arm extending in the vertical direction with a corresponding contacting section protruding into the receiving slot along the transverse direction.

13. The electrical receptacle connector as claimed in claim 12, wherein in each of the pair of contacts, the first spring arm and the second spring arm extend toward each other in the vertical direction in a cantilevered manner.

14. The electrical receptacle connector as claimed in claim 13, wherein in each of the pair of contacts, in a side view the contacting section of the first spring arm passes that of the second spring arm in the vertical direction.

15. The electrical receptacle connector as claimed in claim 12, wherein in each of the pair of contacts, both the first spring arm and the second spring arm are of a fixed beam configuration.

16. The electrical receptacle connector as claimed in claim 12, wherein in each of said pair of contacts, the first spring arm and the second spring arm are same with each other in configuration and dimension.

* * * * *